US005769736A

United States Patent [19]

Sato

[11] Patent Number: 5,769,736

[45] Date of Patent: Jun. 23, 1998

[54] GOLF PUTTER

[75] Inventor: Shozaburo Sato, Minoo, Japan

[73] Assignee: Yugen Kaisha Koshinsha, Osaka, Japan

[21] Appl. No.: 879,648

[22] Filed: Jun. 20, 1997

Related U.S. Application Data

[63] Continuation of Ser. No. 620,323, Mar. 22, 1996, abandoned.

[51] Int. Cl.[6] ..... A63B 53/04

[52] U.S. Cl. ..... 473/335; 473/337; 473/341

[58] Field of Search ..... 473/251, 340, 473/341, 349, 324, 333, 334, 335, 336, 337, 345, 350, 256

[56] References Cited

U.S. PATENT DOCUMENTS

| | | | |
|---|---|---|---|
| 3,516,674 | 6/1970 | Scarborough . | |
| 3,966,210 | 6/1976 | Rozmus | 473/341 |
| 4,010,958 | 3/1977 | Long | 473/341 |
| 4,325,553 | 4/1982 | Taylor | 473/342 |
| 4,655,459 | 4/1987 | Antonious . | |
| 4,898,387 | 2/1990 | Finney . | |
| 5,127,653 | 7/1992 | Nelson . | |
| 5,409,219 | 4/1995 | Saksun . | |
| 5,489,097 | 2/1996 | Simmons | 473/341 |
| 5,580,058 | 12/1996 | Coughlin | 473/340 |

*Primary Examiner*—Sebastiano Passaniti
*Attorney, Agent, or Firm*—Wenderoth, Lind & Ponack

[57] ABSTRACT

A golf putter which can stably maintain the directional stability of its head while being swung so that a golf ball can be rolled accurately along an intended line. Side walls extend rearwardly from both ends of a face portion of the putter. Each side wall carries a weight at its rear end, so that the head is lighter at its face end than its rear end. Thus, the directional stability of the head while swinging the ball improves.

7 Claims, 3 Drawing Sheets

GOLF PUTTER

This application is a continuation of now abandoned application Ser. No. 08/620,323, filed Mar. 22, 1996, abandoned.

BACKGROUND OF THE INVENTION

This invention relates to a golf putter.

A golf putter includes a shaft and a head secured to the lower end of the shaft. Conventional golf putters have heads of various shapes and designs. But they are all plate or lump shaped and fixed to the shaft at a predetermined angle.

Some of such conventional putter heads have their weight distributed substantially uniformly along the width direction of their face, while others have their weight distributed so that they are heavier at their transverse ends. Still other conventional putter heads have a semi-cylindrical shape so that their center of gravity will be located slightly rearwardly along the centerline of the head. Any of these conventional putter heads has its center of gravity located very near to the putting face.

Thus, such heads are low in their ability to move stably along a straight line, so that their putting face can deflect easily due to any slight, unintended motion of the hands of the golfer. If the putting face deflects, it is impossible to putt a golf ball so that the ball will roll accurately along the intended target line. In order to swing such conventional putters so that the putting face dose not angularly deflect, expert-level skill is required for golfers.

An object of this invention is to provide a golf putter which can stably maintain the directional stability of its head without deflecting while being swung so that the putter can roll a golf ball accurately along an intended line.

SUMMARY OF THE INVENTION

According to this invention, there is provided a golf putter including a head having a face portion, side walls extending rearwardly from both ends of the face portion, and weights provided on the rear ends of the side walls.

The side walls are preferably shorter than the width of the face portion. But they should be as long as possible within the maximum length permitted by the international standard which require that the distance from the heel to the toe be greater than the distance from the face to the back of the head. A shaft mounting portion is provided on or near the face portion.

Since the weights are provided at the rear ends of the side walls and the shaft is mounted on or near the face, the head is lighter at the face end than at the rear end. Namely, the center of gravity of the head is located sufficiently spaced rearwardly from the putting face. While the putter is being swung, the weights impart to the head a kind of dragging force, so that the head moves straight along the intended ball rolling line under the self-angle-keeping inertia. Thus, the putting face is accurately positioned so as to be perpendicular relative to the intended ball rolling line at the moment of impact on the ball, so that the ball will roll accurately along the intended ball rolling line. Also when striking the ball, the head of the putter according to the present invention will deflect very little even if the golfers's hands deflect or move irregularly while swinging the putter.

Other features and objects of the present invention will become apparent from the following description which is made with reference to the accompanying drawings, in which:

DETAILED DESCRIPTION OF THE PREFERRED EMBODIMENT

The embodiments are now described with reference to the drawings.

Figure 1:
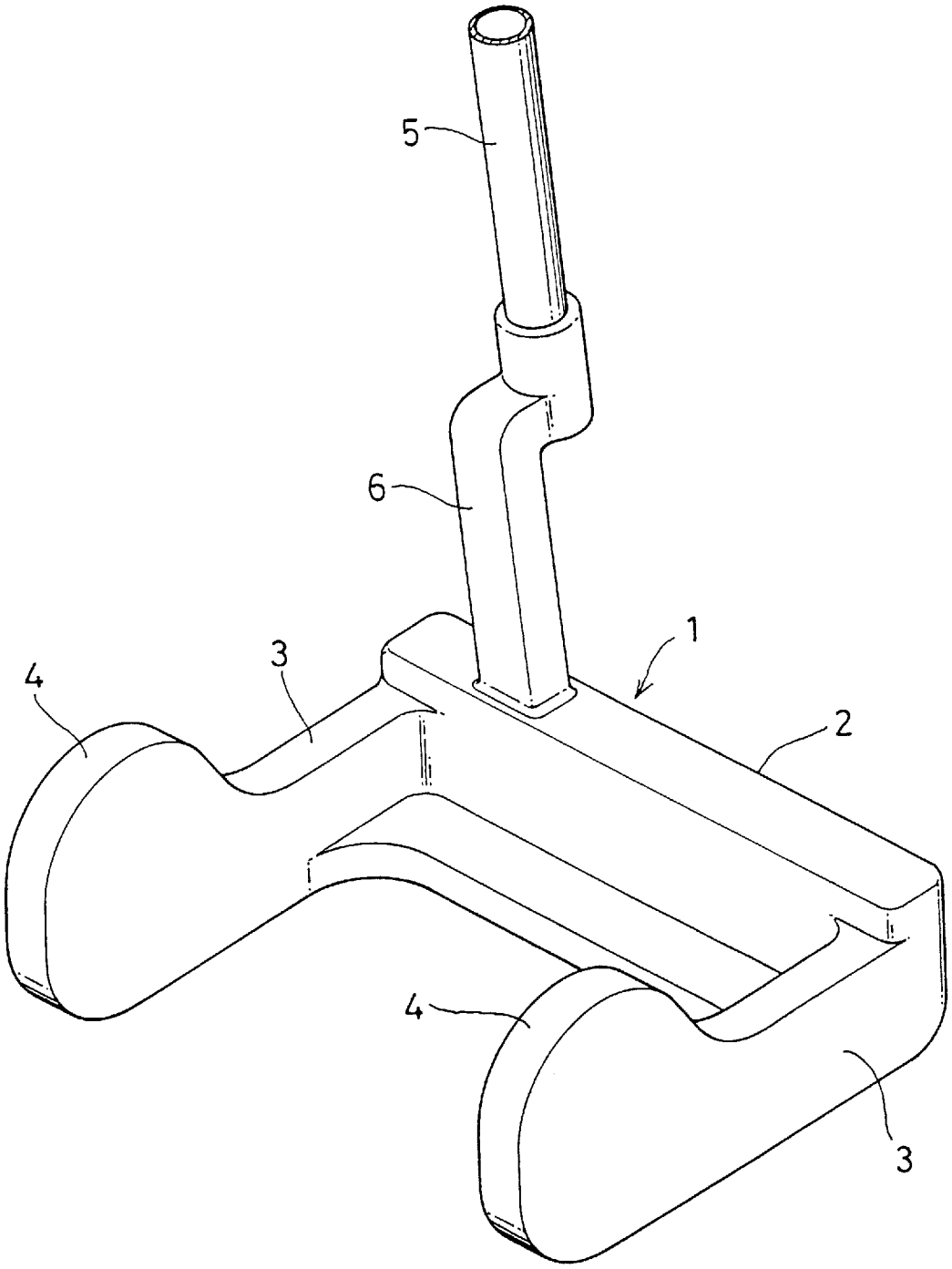
FIG. 1 is a perspective view of a first embodiment of the putter according to this invention.
Figure 2A:
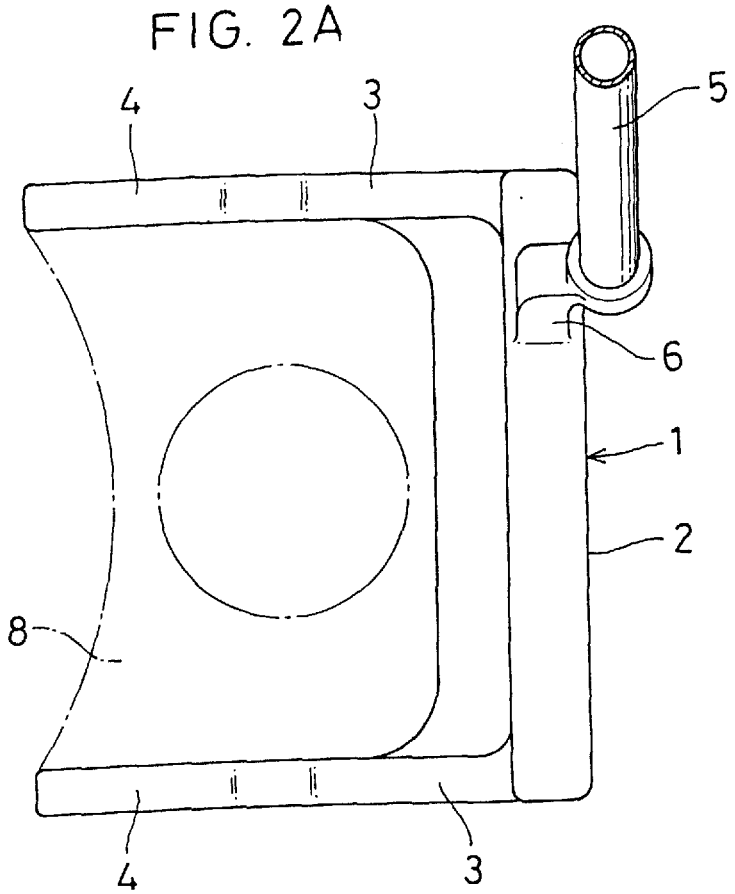
FIG. 2A is a plan view of the same.
Figure 2B:
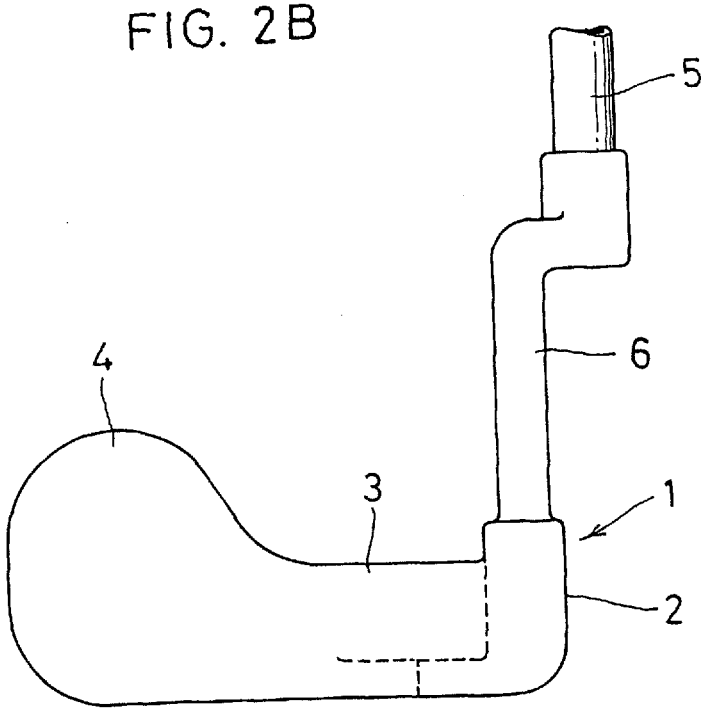
FIG. 2B is a side view of the same.

In the first embodiment shown in FIGS. 1 and 2, the head 1 includes a face portion 2 for striking a golf ball. Side walls 3 extend rearwardly from opposite ends of the face portion 2 at right angles relative to the face portion 2. The head is U-shaped as a whole. Each side wall 3 has a weight 4 at its rear end. A mounting portion 6 for a shaft 5 extends obliquely upward from the top surface of the face portion 2.

The head 1 is made of a metal or any other material having metal-like properties. The face portion 2 and the side walls 3 are integrally formed. The side walls 3 are slightly shorter in length than the width of the face portion 2 so as to satisfy the international standards for putters. But the side walls 3 should be as long as possible within the maximum length permitted by the international standards.

The weights 4 may be the same weight or different weights relative to each other depending upon the club shaft mounting position. In the embodiment shown, the weights 4 are integral arcuate portions protruding upwardly from the rear end of the side walls 3. But they may be separate members which are made of a metal having a large specific gravity such as lead and fixed to the side walls 3. They may have the same weight or different weights. Their weights and shape may be determined freely.

The size of the head 1 is not limited, either. A bottom wall 8 may be provided between and across the lower portions of the side walls 3 as shown by chain line in FIG. 2A. Also, holes may be formed in the side walls 3 and the bottom wall 8 to adjust the weight of the entire head. The face of the head may have its lower portion bent vertically arcuately so that the ball putted by the head will roll a longer distance in a straight line.

Figure 3:
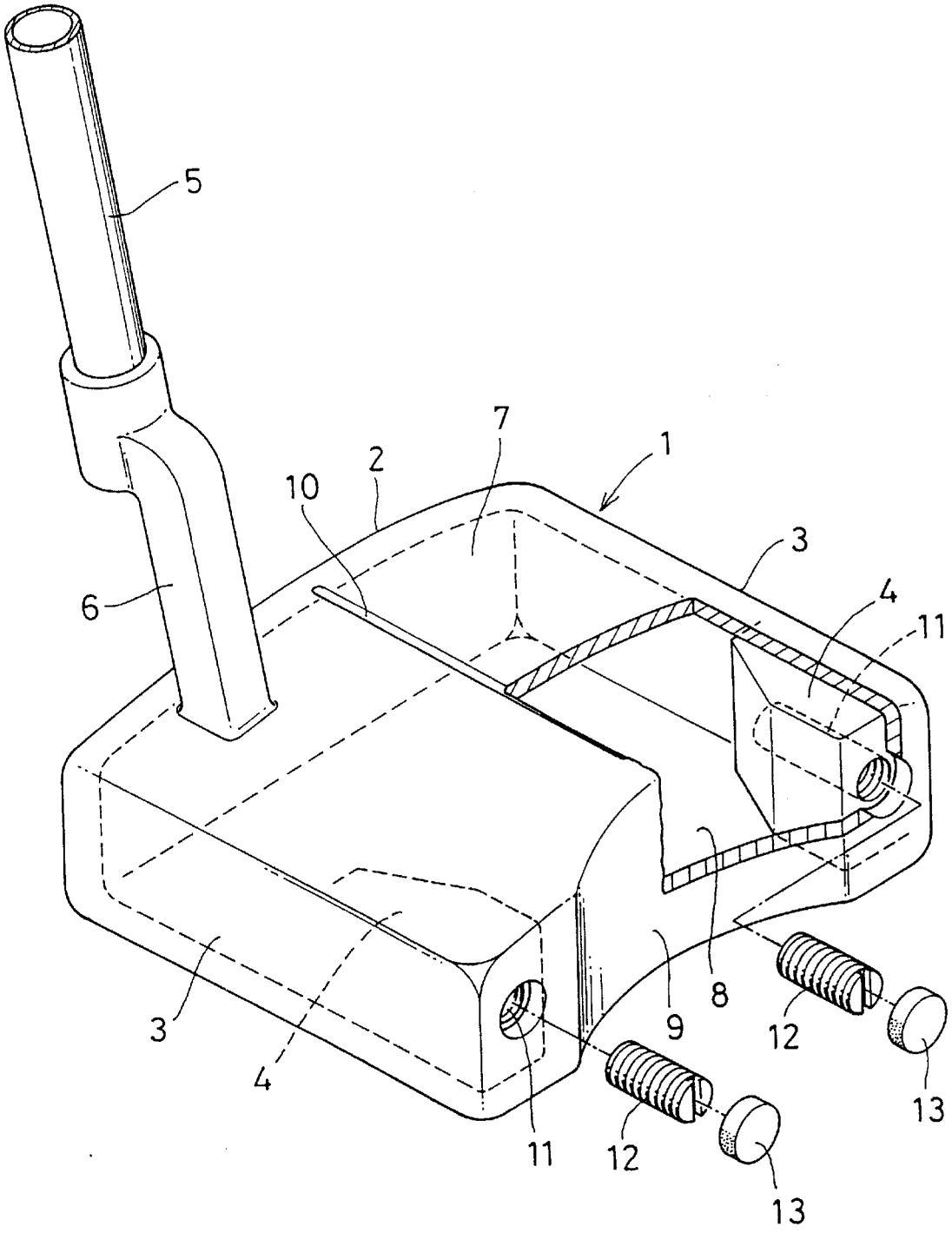
FIG. 3 is a partially cutaway perspective view of a second embodiment of the present invention.

In the second embodiment shown in FIG. 3, a roof wall 7 and a bottom wall 8 extend rearwardly from the top and bottom edges of the face portion 2 between and across the side walls 3. A rear wall 9 closes the opening defined between the roof wall 7 and the bottom wall 8, forming a hollow, closed space in the head 1. A weight 4 is provided at the rear end of each side wall 3.

The mounting portion 6 for the shaft 5 extends obliquely upward from the roof wall 7 so that its top end is located right over the face portion 2. Otherwise, it may be provided on the roof wall 7 in a gooseneck manner. A fairly long sweet spot line 10 is marked so as to extend rearwardly on the top surface of the roof wall 7 from behind the sweet spot on the putting face.

Each weight 4 has a hole 11 opening to the rear end of the weight. Adjusting weights 12 made of a heavy material such as lead and having predetermined weights are inserted into the holes 11 to adjust the weight balance of the weights 4. Caps 13 are fitted in the rear ends of the holes 11 to retain the weights 12 in the holes 11.

To putt a ball with the putter of this invention, a golfer grips the shaft 5, addresses the ball so that the sweet spot will directly face the ball with the face of the head 1 extending perpendicular to the intended ball rolling line, and swings the putter.

While the shaft 5 is being swung, the weights 4, provided at the rear end of the head 1 on both sides, impart to the side walls 3 a kind of dragging force that acts to keep the side walls 3 moving stably in a straight line which is parallel to the intended ball rolling line. The face is thus kept strictly perpendicular to the intended line while the putter is being swung and at the moment of impact on the ball. The ball will thus roll accurately along the intended ball rolling line. Namely, the directional stability of the shot improves greatly.

As a whole, the head 1 has uniform weight distribution on both sides of the sweet spot. The weights 4 are spaced a sufficiently long distance rearwardly from the putting face. The center of gravity of the head 1 is also spaced a sufficiently long distance rearwardly from the putting face because the face portion 2 is much lighter than the rear portion of the head 1. Due to the self-angle-stabilizing inertia of the weights 4, the ability of the head 1 to move straight ahead is improved very little vibration or deflection of the face will occur at the moment of impact on the ball. Thus the ball will roll accurately along the intended ball rolling line. Also, the golfer can get a good response or feel of impact to his hands.

The present invention is applicable to a long putter, which is intrinsically a swing-type putter rather than a tap type. Thus, the long putter employing the present invention works well for the intended purpose.

What is claimed is:

1. A golf putter comprising a putter head including:

a face portion having a first end and a second end;

a first upstanding side wall structure connected to said first end of said face portion and extending rearwardly thereof;

a second upstanding side wall structure connected to said second end of said face portion and extending rearwardly thereof, wherein said face portion, said first upstanding side wall structure, and said second upstanding side wall structure define a U-shaped structure with an area between said first and second side walls being substantially vacant;

a first weight integrally formed with an extreme rear end portion of said first side wall structure, wherein said first weight and said first side wall structure define an upstanding wall having a uniform horizontal width; and a second weight integrally formed with an extreme rear end portion of said second side wall structure, wherein said second weight and said second side wall structure define an upstanding wall having a uniform horizontal width, said first and second side wall structures each has a length which is substantially equal to but slightly shorter than the length of said face portion so that the center of gravity is spaced rearwardly of said putting face toward the rear of the putter head.

2. The golf putter as claimed in claim 1, further comprising a shaft mounting portion provided on said putter head at a location near said face portion.

3. The golf putter as claimed in claim 1, wherein said first and second weight are equal in weight.

4. The golf putter as claimed in claim 1, wherein said first and second weight are of different weights.

5. The golf putter as claimed in claim 1, wherein said first and second weights protrude upwardly from said rear end portion of said first and second side wall structures, respectively.

6. The golf putter as claimed in claim 5, wherein each of said first and second weights form an upwardly protruding arcuate portion.

7. A golf putter including a putter head comprising:

a face portion having a first end and a second end;

a first side wall structure connected to said first end of said face portion and extending rearwardly thereof;

a second side wall structure connected to said second end of said face portion and extending rearwardly thereof, a top wall extending from an upper portion of said face portion and between an upper portion said first side wall structure and an upper portion of said second wall structure;

a bottom wall extending from a lower portion of said face portion and between a lower portion of said first side wall structure and a lower portion of said second side wall structure;

a rear wall connecting said first side wall structure, said second side wall structure, said top wall, and said bottom wall;

a first weight provided only at a rear end portion of said first side wall structure; and a second weight provided only at a rear end portion of said second side wall structure, wherein said first and second side wall structures each has a length which is substantially equal to but slightly shorter than the length of said face portion so that the center of gravity is spaced rearwardly of said putting face toward the rear of the putter head, wherein said first weight and said second weight are connected to an inside surface of said first side wall portion and an inside surface of said second side wall portion, respectively, and said first and second weights each include a threaded opening for receiving a threaded adjusting weight.

* * * * *